United States Patent [19]

Kanamaru et al.

[11] Patent Number: 4,644,850

[45] Date of Patent: Feb. 24, 1987

[54] FLUID MACHINE

[75] Inventors: Hisanobu Kanamaru; Kazushi Sasaya; Tomiyasu Onuma; Akira Tohkairin, all of Katsuta, Japan

[73] Assignee: Hitachi, Ltd., Tokyo, Japan

[21] Appl. No.: 814,757

[22] Filed: Dec. 30, 1985

[30] Foreign Application Priority Data

Dec. 29, 1984 [JP] Japan ..... 59-280145
Dec. 29, 1984 [JP] Japan ..... 59-280147

[51] Int. Cl.[4] ..... F01B 13/04; F04B 1/12

[52] U.S. Cl. ..... 91/507; 91/449; 417/269

[58] Field of Search ..... 417/269; 91/499, 507

[56] References Cited

U.S. PATENT DOCUMENTS

| | | | |
|---|---|---|---|
| 1,364,508 | 11/1921 | Moody | 417/269 |
| 3,228,303 | 1/1966 | Budzich | 91/499 |
| 3,656,299 | 4/1972 | Fleury | 91/499 |
| 3,749,523 | 7/1973 | Wahl | 417/269 |
| 4,283,997 | 8/1981 | Tahahashi | 417/269 |

FOREIGN PATENT DOCUMENTS

| | | | |
|---|---|---|---|
| 518432 | 3/1927 | Fed. Rep. of Germany | 417/269 |
| 1127830 | 4/1982 | Fed. Rep. of Germany | 91/507 |
| 1024850 | 3/1963 | United Kingdom | 91/507 |

*Primary Examiner*—Carlton R. Croyle
*Assistant Examiner*—Paul F. Neils
*Attorney, Agent, or Firm*—Antonelli, Terry & Wands

[57] ABSTRACT

A fluid machine comprises a cylinder block mounted on a rotary shaft, a rotary plate an axis of which is intersecting with an axis of the rotary shaft by an acute angle, a gear engaging mechanism for engaging the rotary plate with the rotary shaft to cyclically rotate the same, a piston supported by the rotary plate and inserted into a throughhole provided in the cylinder block a suction system and a delivery system for effecting suction and delivery operation by a rotation of the cylinder block and the piston, a spherical contact portion disposed between the rotary plate and the rotary shaft and adapted to receive thrust generated between the same, and a passage for leading to the spherical contact portion a high-pressure working gas including lubricating oil generated in the delivery system.

4 Claims, 7 Drawing Figures

FLUID MACHINE

BACKGROUND OF THE INVENTION

The present invention relates to a fluid machine, including a gas pump and a gas compressor, which employs a gas as a working fluid.

In general, a swash-plate-type compressor is employed as a gas compressor for use in a cooler, an air-conditioner, or the like.

However, the swash-plate-type compressor has a structural drawback in that its efficiency is poor since a piston is moved vertically within a stationary cylinder by the swash plate.

In commonly assigned U.S. application Ser. No. 770,581 a novel compressor with improoved efficiency is proposed for solving the problems of this swash-plate-type compressor. However, while this proposed compressor is quite rational in terms of its structure, it is necessary to consider the lubrication in the motion converting mechanism thereof.

Accordingly, an object of the present invention is to rationally carry out the lubrication in the motion converting mechanism and then to improve its durability.

The present invention is characterized in that a spherical contact structure is employed for mutual contact between a shaft having a rotary cylinder block and a shaft having a rotary plate rotating synchronously with the cylinder block, and that a high-pressure working gas containing lubricating oil on the delivery side is induced to this spherical contact structure portion.

According to this arrangement, it is possible to supply the working gas containing lubricating oil to the spherical contact structure portion by a high pressure generated in the operating process. As a result, it is possible to rationally effect the lubrication in the spherical contact structure portion, thereby improving the durability thereof.

DETAILED DESCRIPTION

Figure 1:
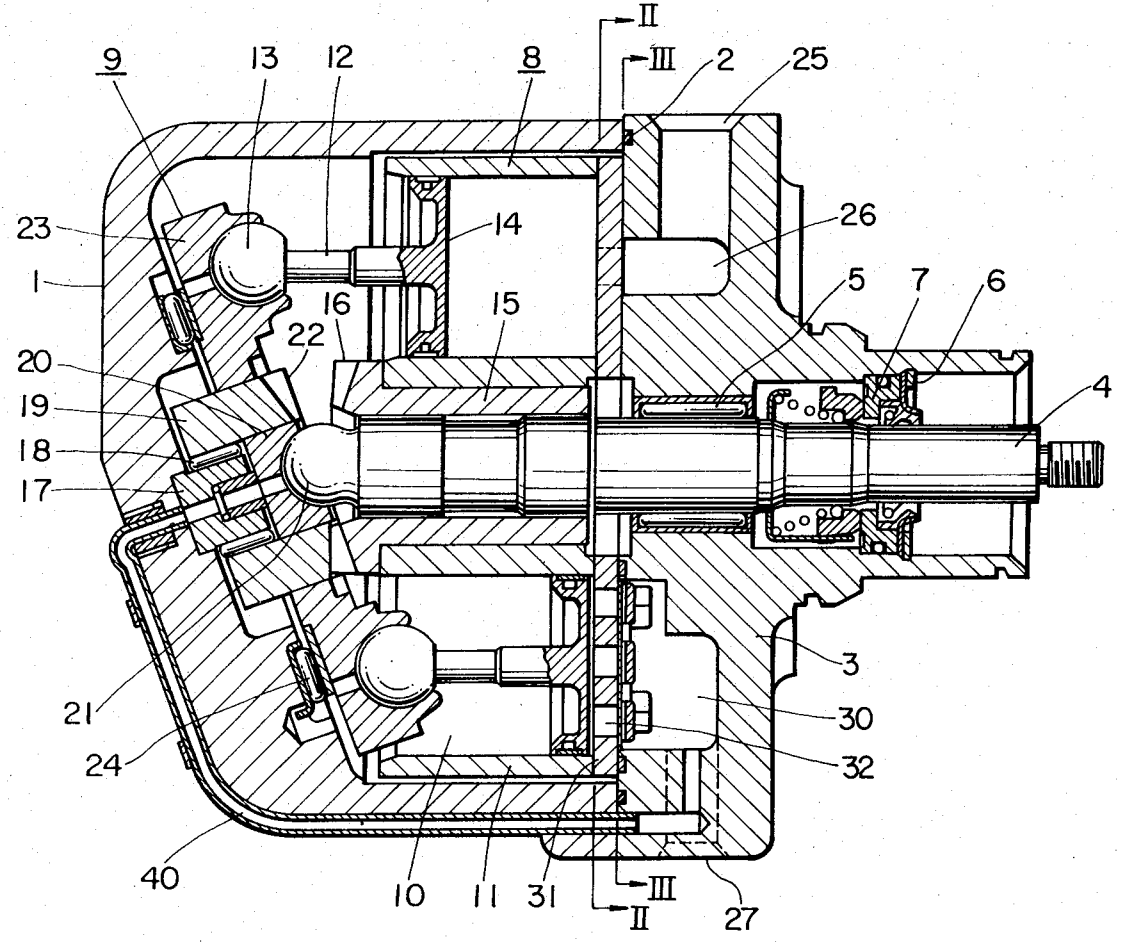
FIG. 1 is a longitudinal cross-sectional view of an air compressor according to one embodiment of the invention.

Referring now to the drawings wherein like reference numerals are used throughout the various views to designate like parts and, more particularly, to FIG. 1, according to figure, a swash plate type compressor includes an end plate 3 secured to an end opening of a bowl-shaped casing 1 through an O-ring 2 by means of several screws (not shown). A rotary shaft 4 is inserted into a central portion of the end plate 3 and is rotatably carried by the end plate 3 through a needle bearing 5, with a mechanical seal mechanism, secured by a clip 6, being provided on an outside of the needle bearing 5. A working chamber assembly 8 and a motion converting mechanism portion 9 are housed within the casing 1, with the working chamber assembly 8 including a cylindrical block 11 having a plurality of throughholes 10 provided at equal intervals and a plurality of pistons 14 each having a rod portion 12 stored in the throughhole 10 and a spherical portion 13.

A tubular shaft 15 with a cylinder block 11 presss-fit and secured thereto is press-fitted and secured to one end portion of the rotary shaft 4 so as to be made integral therewith. A bevel gear, or a helical gear 16 in this case, is integrally formed at the end of the shaft 15.

A stationary column or projection 17 is studded in the casing 1, and a shaft 19 is rotatably carried by the column 17 through a needle bearing 18. The axis of the stationary column 17 and the axis of the rotary shaft 4 intersect each other at a predetermined angle, and the stroke of the piston 14 is determined by this angle.

A bearing member 20 is provided inside the shaft 19, which has a spherical bearing surface for receiving a spherical portion 21 formed at the end of the rotary shaft 4, and helical gear teeth 22 for engaging with the helical gear teeth 16 of the shaft 15 are formed on a shaft 19 whereby it is possible to synchronously rotate the cylinder block 11 and the shaft 19.

The motion converting mechanism 9 includes an annular rotary plate 23 secured at an inner periphery thereof to a periphery of the shaft 19, with the spherical portion 13 of the piston 14 being carried by the end surface thereof. A needle bearing 24 is provided between the annular rotary plate 23 and the casing 1 so as to receive the moving load of the piston 14.

Figure 2:
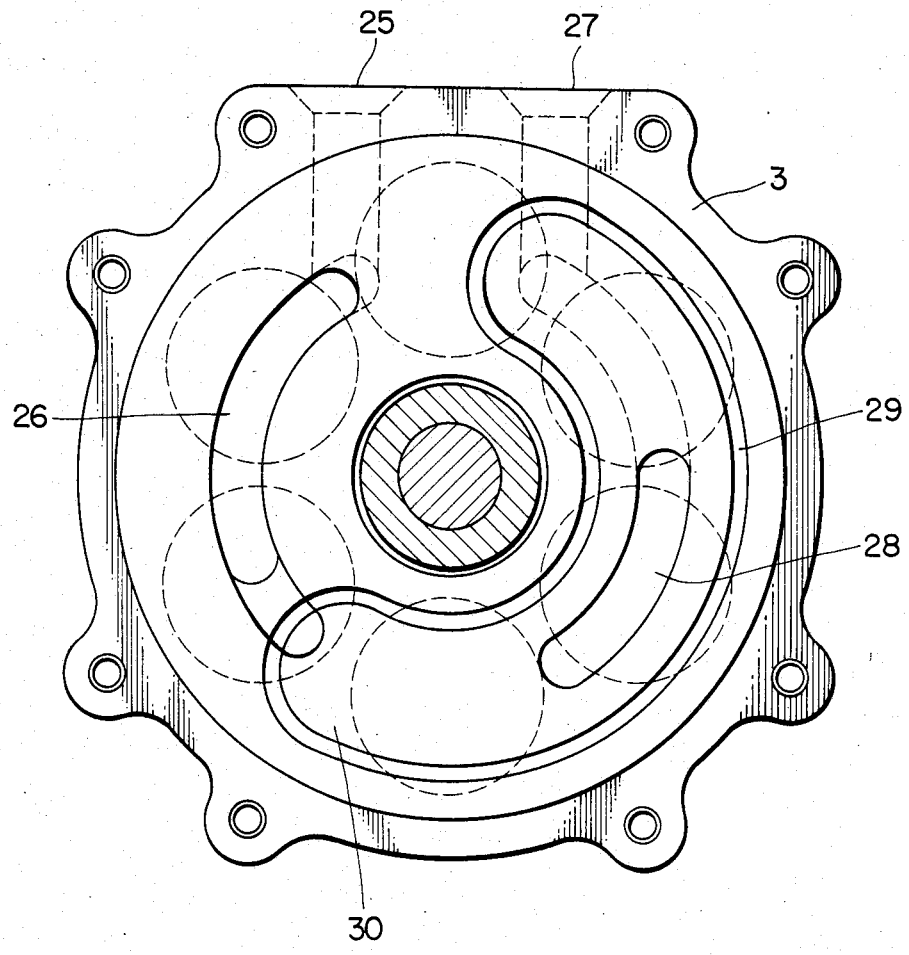
FIG. 2 is a cross-sectional view taken along the line II—II of FIG. 1.
Figure 3:
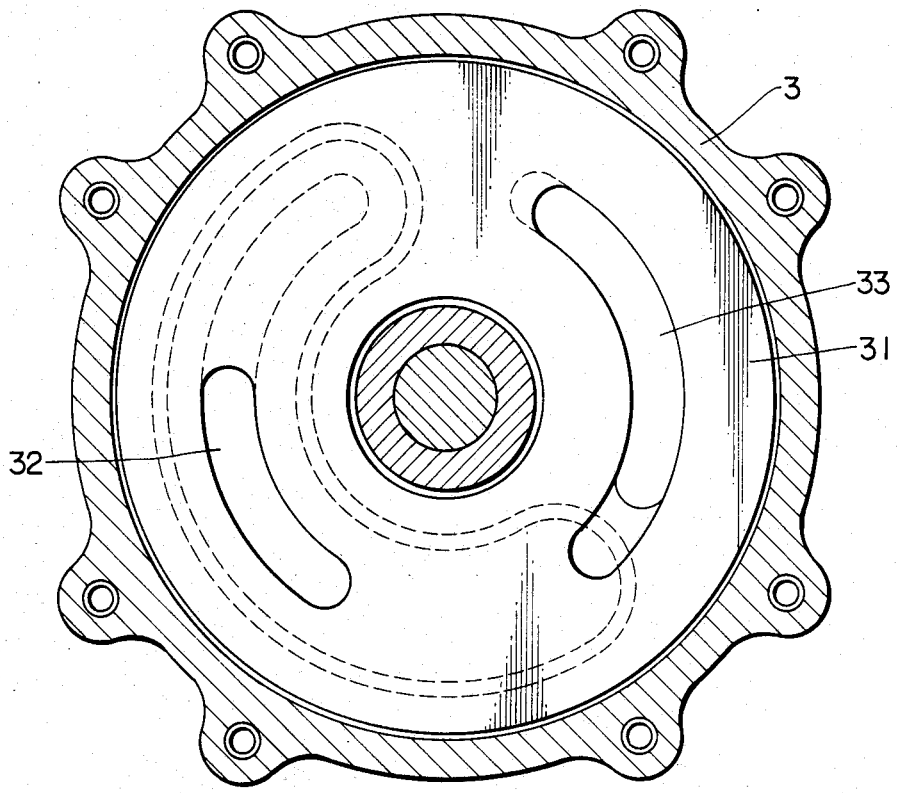
FIG. 3 is a cross-sectional view taken along the line III—III of FIG. 1.

As shown in FIGS. 2 and 3, the inner wall surface of the end plate 3 is provided with an arc-shaped low-pressure passage 26 for communicating with a suction port 25 as well as an arc-shaped high-pressure passage 26 diametrically opposing the passage 26 and communicating with a delivery port 27. A seal ring 29 made of rubber or similar material is embedded in around the high-pressure passage 28 so as to form a high-pressure chamber 30. Since this high-pressure chamber 30 can be formed by embedding the seal ring 29, it is not necessary to provide the same by actively providing a difference in level. However, when providing a difference in level, the level difference may be formed on the end surface of a float valve to be described later. A float valve 31 for controlling the cylinder head is made of a steel plate with a doughnut shape and is disposed between the end plate 3 and the cylinder block 11 end, as shown most clearly in FIG. 3, the float valve 31 is provided with a high-pressure passage 32 and a low-pressure passage 33, with these passages 32, 33 being opposite to the respective passages formed in the end plate 3. The float valve 31 is disposed concentrically with the rotary shaft 4 with a small gap between the outer periphery of the float valve 31 and the inner periphery of the casing 1. Incidentally, the float valve 31 per se may be provided substantially on the high-pressure side, so that the steel plate may be cut out in an arc-shape slightly larger than the range of the seal ring 2, and the other portion of the steel plate may be disposed so as to be secured to the casing 1.

In the above-described arrangement, if the rotary shaft 4 is rotated by, for example, an internal combustion engine, which in turn rotates the cylinder block 11 in a synchronous relation with the rotary shaft 4. At the same time, since the shaft 19 is also rotated through the helical gear teeth 16 of the shaft 15 and the helical gear teeth 22 of the shaft 19, the rotary plate 23 is also rotated at the same time.

Thus, if the cylinder block 11 and the rotary plate 23 are synchronously rotated, for example, in a counter-clockwise direction as viewed in FIG. 2, the piston 14 located at the vicinity of the influx starting end of the low-pressure passage 26 is located at a position slightly moved to the bottom dead center from the top dead center. As the cylinder block 11 is rotated counter-clockwise, the piston 14 moves toward the bottom dead center, and, at the vicinity of the influx completing end of the low-pressure-side passage 26, the piston 14 is located at a position slightly closer to the top dead center from the bottom dead center.

When the piston 14 is located at the bottom dead center, the throughhole 10 of the cylinder block 11 is at a position which overlaps with neither the low-pressure passage 26 nor the high-pressure passage 28. Furthermore, when the cylinder block 11 is rotated, the piston 14 moves toward the top dead center from the vicinity of the efflux starting end of the high-pressure passage 28, and, at the vicinity of the efflux completion end, the piston 14 is located slightly closer to the bottom dead center side from the top dead center. Of course, when the piston is at the top dead center, the throughhole 10 of the cylinder is at a position which overlaps with neither the low-pressure passage 26 nor the high-pressure passage 28. Next, when the high-pressure passage 28 is placed under high pressure, an area defined by the inner wall surface of the cylinder block 11 and the float valve 31 is placed under high pressure by the seal ring 29. Consequently, the float valve 31 is pressed against the end surface of the cylinder block 11 to gas-tightly seal the throughhole 10 by itself.

Accordingly, while the high-pressure passage 28 is held under high pressure, the float valve 31 is constantly pressed against the cylinder block 11 by itself and constantly maintains the cylinder block 11 gas tight stable. In addition, since it is of the self-operating type, as mentioned above, there is no need to especially providie a separate pressing means, and the float valve 31 can thus be made with a siimple construction, high reliability, and outstanding productivity.

Furthermore, in a case where a float valve 31 is employed on only the high-pressure side, it is possible to make the float valve 31 by a material different from that for the cylinder head, and this arrangement can be adopted advantageously when an attempt is made to produce lightweight products.

Description will now be made of the lubricating means which constitutes one of the characteristic features of the present invention.

Figure 4:
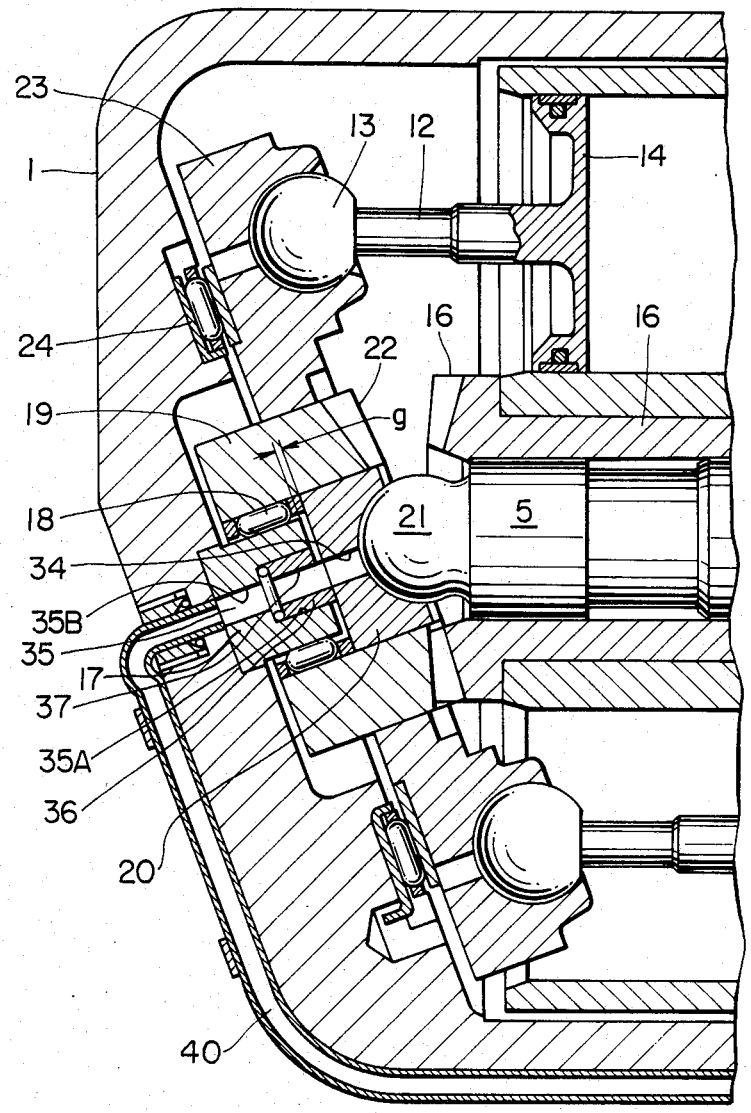
FIG. 4 is an enlarged fragmentary sectional view of the compressor shown in FIG. 1.
Figure 5:
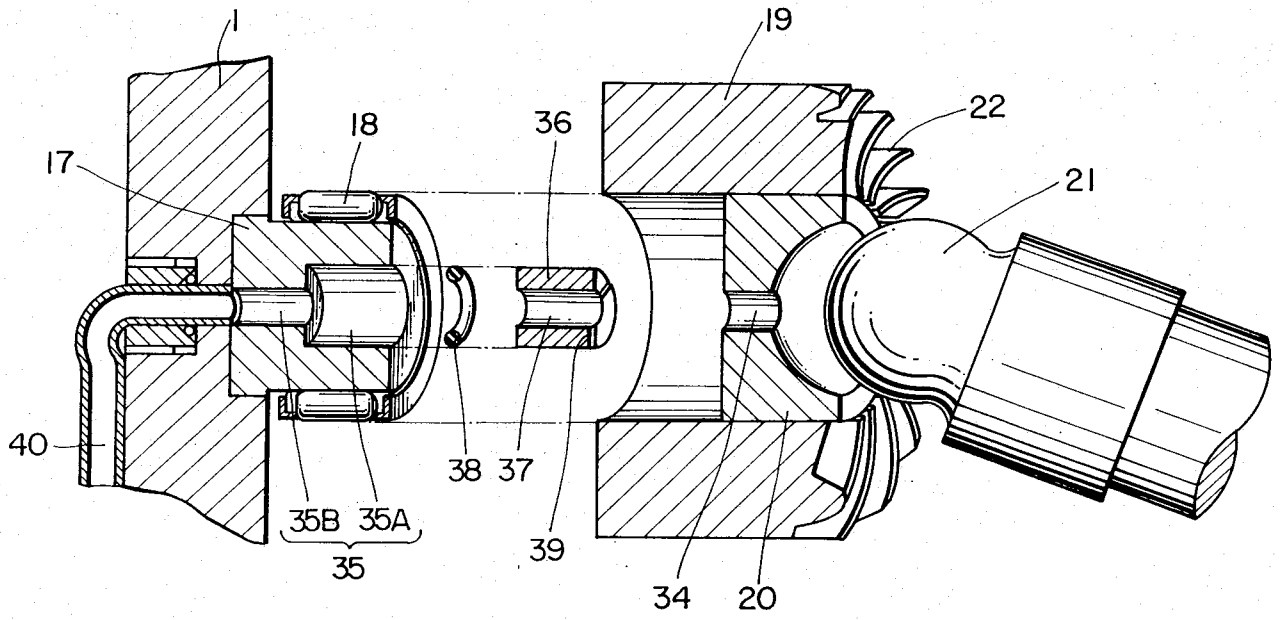
FIG. 5 is an exploded perspective view of FIG. 4.

In FIGS. 1, 4 and 5, the tip of the stationary column or projection 17 is opposed to the bottom of the bearing member 20 with a slight gap g therebetween, with the gap g communicating with the contact surfaces between the bearing member 20 and the spherical portion 21 through an oiling or lubricating passage 34 provided in the bearing member 20.

The stationary column or projection 17 is provided at a center thereof with an axial throughhole 35 including a large diameter portion 35A and a small diameter portion 35B, an axis of which is in alignment with the axis of the oiling passage 34.

A cylindrical member 36 is disposed inside the large diameter portion 35A, while an oiling or lubricating passage 37 penetrating this cylindrical member 36 is communicated with the small diameter portion 35B. The cylindrical member 36 should preferably be made of a low-friction material (e.g., tetrafluoroethylene resin, molybdenum disulfide) or an oil-containing material.

In a shoulder portion between the cylindrical member 36 and the throughhole 35 of the column 17, an O-ring 38 is interposed so press the cylindrical member 36 against the bottom of the spherical bearing 20 and to come into contact with the same. A radially extending oil groove 39 as formed at the side surface of the spherical bearing 20 of the cylindrical member 36.

In addition, the throughhole 35 of the column 17 is connected to the high-pressure chamber 30 through an oiling or lubricating pipe 40. Although the illustrated oiling pipe 40 is not integral with the casing 1, it is possible to form an oiling or lubricating passage in the casing 1. Moreover, connection may not be confined to the high-pressure chamber 30, but it may be made to a portion where the pressure is relatively high.

In the above-described arrangement, a gas containing lubricating oil, for example, a refrigerant used in a compressor, is compressed by the rotation of the cylinder block 11 so as to assume high pressure and is sent to an expansion valve in a cycle system through the high-pressure chamber 30. A part of this high-pressure refrigerant is supplied to the throughhole 35 formed in the column 17 through the oiling pipe 40.

The refrigerant containing lubricating oil sent to the throughhole 35 passes through the oiling passage 37 of the cylindrical member 36, and reaches the oiling passage 34 of the bearing member 20, and is then supplied to the contact surfaces between the bearing member 20 and the spherical portion 21 so as to effect lubrication of these portions.

Meanwhile, a part of the refrigerant passing through the oiling passage 37 of the cylindrical member 36 flows out to the side of the needle bearing 18 through an oil groove 39 and further flows out to the side of the needle bearing 24. Subsequently, the refrigerant and lubricating oil are re-drawn by the piston 14 which is in a suction stroke and are returned to the cycle system.

In such a construction, since the working gas contains lubricating oil, it becomes possible to lubricate the spherical bearing portion by supplying a part of the working gas thereto, with the result that the durability of this portion can be substantially improved.

The above description has been made of a fluid machine of the type in which the influx and efflux of a gas takes place on the side of the rotary shaft 4. Next, description will be made of a fluid machine of the type in which the influx and efflux of a gas are carried out on the side opposite to the rotary shaft 4.

Figure 6:
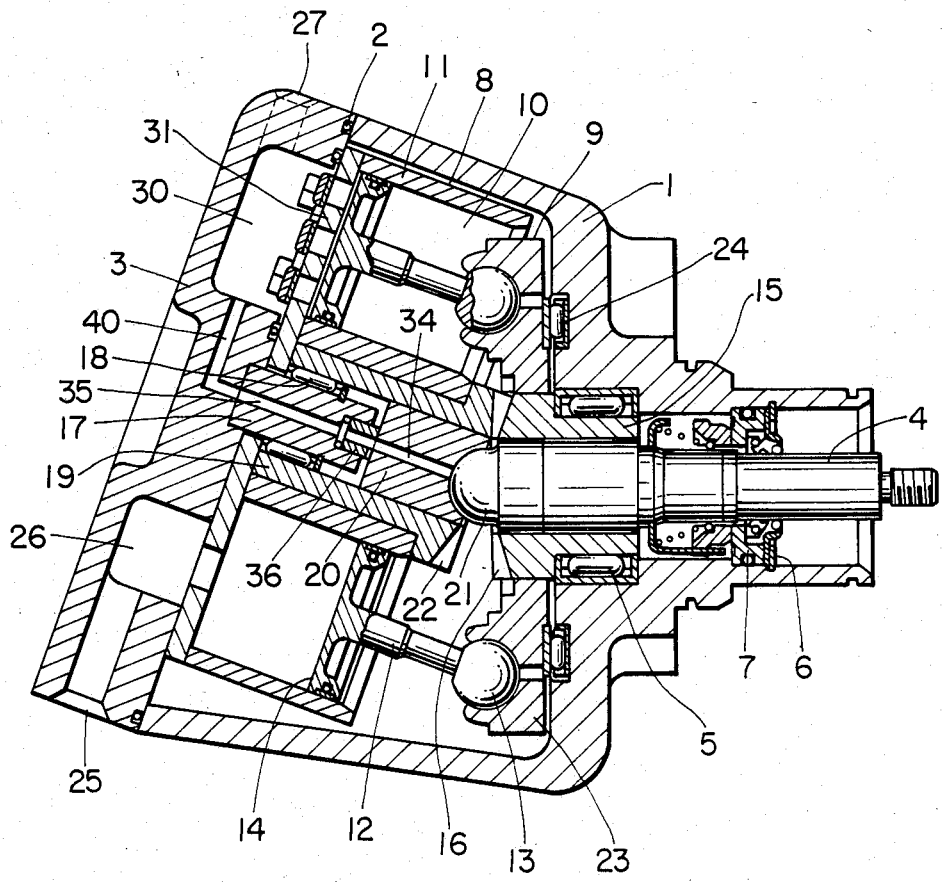
FIG. 6 is a longitudinal cross-sectional view of a compressor according to another embodiment of the invention.

In FIG. 6, the end plate 3 is secured to an end opening of a bowl-shaped casing 1 via an O-ring 2 by several screws (not shown). The rotary shaft 4, which is fitted with the shaft 15 having at the tip thereof a bevel gear or a helical gear 16 in this case, is inserted into a center of the casing 1. The shaft 15 is retained in the casing 1 through a needle bearing 5. In addition, a mechanical seal mechanism 7, prevented from falling off from the rotary shaft 4 by the clip 6, is disposed between the cylindrical portion of the casing 1 and the rotary shaft 4.

Inside the casing 1 are housed the working chamber assembly 8 and the motion converting mechanism 9, with the working chamber assembly 8 including a cylinder block 11 having a plurality of throughholes 10 provided at equal intervals and piston devices each having a piston 14 fitted to the throughhole 10, a rod 12, and the spherical portion 13 constituted by a steel ball. The cylinder block 11 is made of a light alloy, e.g. aluminum alloy. A stationary column or projection 17, an axis of which is disposed at an inclination of 20° with respect to an axis of the rotary shaft 4, is studded on the inner wall surface of the end plate 3. A cylindrical shaft 19, having at one end thereof a helical gear 22 which is engagable with the helical gear 16, is installed to the outer periphery of the column 17 via a needle bearing 18. The cylinder block 11 is fitted to the outer periphery of the shaft 19, and a bearing member 20 for receiving the spherical portion 21 integrally formed with the rotary shaft 4 or a ball which is separately formed is secured to the inner periphery of the shaft 19. The end plate 3 is provided with an arc-like low-pressure passage 26 communicating with the suction port 25 and an arc-like high-pressure passage 30 formed opposing the passage 26 and communicating with the delivery port 27. As in the case of the aforementioned embodiment, a seal ring, made of a rubber material or the like is embedded around the high-pressure passage 30 so as to form a high-pressure chamber. This high-pressure chamber can be formed more simply if it is set slightly lower level than the inner wall surface, and the high-pressure chamber can be formed by embedding the seal ring. Therefore, it is not necessary to provide the high-pressure chamber by actively providing a difference in level. However, if a difference in level is to be provided, it may be formed on the end surface of the float valve 31 made of a steel plate with a doughnut shape and disposed between the end plate 3 and the cylinder block 11. The float valve 31 is provided with a high-pressure passage and a low-pressure passage which oppose the respective passages formed in the endplate 3. The float valve 31 is disposed with a gap between an outer periphery thereof and an inner periphery of the casing 1 and to be concentrical with the column 17. Incidentally, since the float valve 31 per se may be disposed substantially on the high-pressure side, an arc-shaped portion slightly larger than the range of the seal ring 2 may be cut out, and it is better to dispose the portion of the steel plate other than the cut out portion so as to be fixed on the casing 1.

Figure 7:
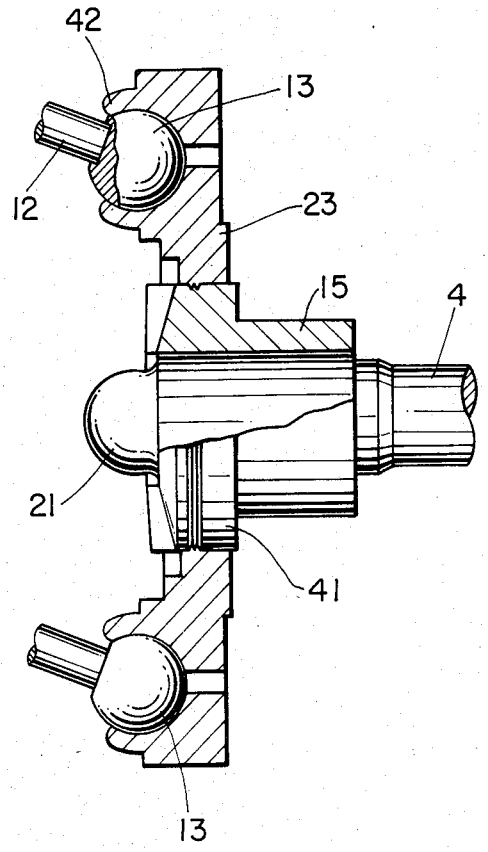
FIG. 7 is an enlarged fragmentary sectional view of the compressor shown in FIG. 6.

A rotary plate 23, of an aluminum alloy or the like, is secured to the outer periphery of the shaft 15, a rear end of which is supported by the casing 1 through a thrust bearing 24. As shown in FIG. 7, after fitting a central portion of the rotary plate 23 to the shaft 15, a central portion of the rotary plate 23 is locally vertically pressed. A part of the rotary plate 23 is plastically deformed and flows perpendicularly into a preformed annular groove 41 whereby the rotary plate 23 is mechanically coupled to the shaft 15 by the thrust created around the annular groove 41. Meanwhile, the spherical portion 13 of the piston device is rotatably inserted into a surface of the rotary plate 23, and is pivotally supported by the caulking force or crimping force applied to the peripheral portion 42 of the opening so as to be returned in the rotary plate 23.

Incidentally, the coupling between the spherical portion 13 and the rod 12 is effected by plastic deformation of the rod 12, as described before. In addition, the piston 14 and the rod 12 are made lightweight by integrally forming them of an aluminum material.

Furthermore, the oiling or lubricating passage 34 provided between the high-pressure passage (high-pressure chamber) 30 of the end plate 3 is communicated with the oiling passage 34 provided in bearing member 20 through the oiling or lubricating passage 40 and the throughhole 35 so as to form an oiling or lubricating system. The cylindrical member 36 is disposed between the column 17 and the bearing member 20 so as to serve as a damper for thrust forces and to distribute lubricating oil. The arrangement of these lubricating systems is substantially identical with that shown in FIG. 5.

In the aforementioned arrangement, if the rotary shaft 4 is rotated by, for instance, an internal combustion engine, the rotary plate 23 is rotated by the shaft 15, which, in turn, simultaneously rotates the shaft 19 by the helical gears 16 and 22 and also rotates the cylinder bolcks 11.

Thus, if the cylinder blocks 11 and the rotary plate 23 are synchronously rotated in a counterclockwise direction, for example, the piston 14, located at the vicinity of the influx starting end of the low-pressure-side passage 26, is at a position slightly moved toward the bottom dead center from the top dead center. Then, as the cylinder block 11 is rotated, the piston 14 moves toward the bottom dead center, and, at the vicinity of the influx completing end of the low-pressure-side passage, the piston 14 is at a position slightly moved toward the top dead center from the bottom dead center.

Here, if the piston 14 is at the bottom dead center, the throughhole 10 of the cylinder block 11 is placed at a position which overlaps with neither the low-pressure passage 26 nor the high-pressure passage 30. Furthermore, as the cylinder block 11 is rotated, the piston moves toward the top dead center from the vicinity of the efflux starting end of the high-pressure passage 30, and at the vicinity of the efflux completing end, the piston 14 is located at a position slightly moved to the bottom dead center from the top dead center. Of course, when the piston 14 is at the top dead center, the throughhole 10 of the cylinder block 11 is placed at a position which overlaps with neither the lower-pressure passage 26 nor the high-pressure passage 30. Then, when the high-pressure passage 30 assumes high pressure, an area defined by the inner wall surface of the cylinder block 11 and the float valve 31 assumes high pressure, with the result being that the float valve 31 is pressed against the end surface of the cylinder block 11 to gas-tightly seal the throughhole 10 by itself.

Accordingly, while the high-pressure passage 30 is held under high pressure, the float valve 31 is constantly pressed against the cylinder block 11 gas-tight stably. In addition, since it is of the self-operating type, as mentioned above, there is no need to especially provide a separate pressing means, and the float valve 31 can thus be made with a simple construction, high reliability, and outstanding productivity.

Furthermore, in a case where a float valve is employed on only the high-pressure-side, it is possible to make the float valve from a material diffrerent from that for the cylinder head, and this arrangement can be advantageously adopted when an attempt is made to produce lightweight products, and, at the same time, the sealing capability can also be further increased. As for the operating condition of the compressor, compression is normally effected by mixing a refrigerant and lubricating oil. As a result, simultaneously as a high-pressure chamber is formed, lubricating oil is supplied to the spherical bearing surface of the bearing member 20 through the oiling passage 40 and the throughhole 35. Oil gushing out from the cylindrical member 36 lubricates the bearing 18 as well, thereby maintaining smooth lubrication by itself. These oiling passages require no intricate arrangements and are extremely good in terms of external appearance since these passages are formed internally by using component parts of the main body.

Furthermore, since the rotary plate 23 is disposed on the side of the rotary shaft 4, the load applied to the bevel gear in a driving state is small, and it becomes possible to effect operation with a small driving force. In addition, it becomes possible to make the energy of inertia of the piston device small by forming the piston and the rod by a light metal such as aluminum, thereby contributing to making a lightweight piston device and substantially improving the life of the piston seal. Hence, a compressor of a rotary cylinder type can be realized. In other words, a compact and high-performance compressor can be realized.

In addition, as is apparent from the embodiments shown in FIGS. 1 and 6, in terms of the direction of its inclination, the rotary plate 23 should be preferably inclined toward the high-pressure passage 30.

The reason for this is that the force to which the piston is subjected in the vicinity of the high-pressure passage 30 becomes large, and this force is transmitted to the rotary plate 23 through the rod 12 and the spherical portion 13. In other words, in FIG. 1, if the low-pressure passage 26 is made into the high-pressure prassage 30, the area of contact between the spherical bearing surface of the bearing member 20 and the spherical portion 21 on the high-pressure side becomes small, which reduces the mechanical strength.

In contrast, if the arrangement is made as shown in FIG. 1 or FIG. 6, the area of contact between the spherical bearing surface of the bearing member 20 and the spherical portion 21 on the high-pressure side becomes large, thereby increasing the mechanical strength.

As mentioned above, according to the present invention, since a working gas containing lubricating oil is induced to spherical contact structure portions of a shaft having a cylinder block and a shaft having a rotary plate, the durability thereof can be substantially improved.

What is claimed is:

1. A fluid machine comprising:

a casing with a bottom;

a rotary shaft projecting into said casing;

a shaft having a cylinder block and being secured to said rotary shaft;

a stationary projection formed integrally into the bottom of said casing and having an access which intersects with an access of said rotary shaft at an acute angle;

a shaft having a rotary plate and rotatably rotated by said stationary projection;

a gear engaging mechanism provided on both of said shafts to engage with each other;

a plurality of pistons supported by said rotary plate and inserted in throughholes formed in said cylinder block;

a spherical contact means interposed between the end portion of said rotary shaft and said shaft having the rotary plate;

a suction system and a delivery system for effecting suction and delivery operation by the rotation of said cylinder block and said pistons;

a passage for inducing to said spherical contact means a high-pressure working gas containing lubricating oil generated in said delivery system; and wherein said spherical contact means includes mutually complementary shapes provided between the end portion of said rotary shaft and said shaft having the rotary plate, said spherical contact means including a spherical portion secured to the end portion of said rotary shaft and a spherical recess bearing surface formed in a central portion of said shaft having the rotary plate, said high pressure working gas containing the lubricating oil is induced to said spherical means through an oiling passage formed in said spherical bearing; and wherein said spherical bearing surface has a very small gap with the end portion of said stationary projection, a cylindrical member is provided in a throughhole formed in said stationary projection and has therein an oiling passage passing through said very small gap to come into contact with said spherical bearing surface, and said oiling passage of said cylindrical member is connected to said oiling passage formed in said spherical bearing surface.

2. A fluid machine according to claim 1, wherein a bearing is interposed between said stationary projection and said shaft having the rotary plate, said high-pressure working gas containing lubricating oil is induced to said bearing through a passage extending in the radial direction of said cylindrical member.

3. A fluid machine comprising:

a substantially bowl-shape casing for rotatably carrying a driving shaft and forming an outer case;

an end plate for gas-tightly sealing an opening of said casing;

a driven shaft rotatably supported by a stationary projection provided on said end plate said driven shaft having an axis which intersects with an axis of said driving shaft at an acute angle, and an outer periphery of said driven shaft projecting mainly from a tip thereof is engaged with said driving shaft through a bevel gear means;

a cylinder block encircling said driving shaft and rotating integrally with said driven shaft;

a rotary plate disposed adjacent to an inner wall surface of said casing and secured to an outer periphery of said driving shaft;

gear means provided on said driven shaft and driving shaft for engagement with each other;

a plurality of piston means with each piston means having one end disposed in a corresponding throughhole of said cylinder block and another end retained by said rotary plate;

a spherical contact means disposed between an end portion of said driving shaft and said driven shaft for receiving a thrust generated therebetween;

a suction system and a delivery system for effecting suction and delivery operation by the rotation of said cylinder block and said plurality of piston means;

passage means for inducing to said spherical contact means a high-pressure working gas containing lubricating oil generated in said delivery system;

said spherical contact means includes a spherical portion secured to an end portion of the driving shaft and a spherical recess bearing surface formed in a central area of said driven shaft, said high-pressure working gas containing the lubricating oil is induced to said spherical contact means through an oiling passage formed in said spherical bearing surface; and wherein said spherical bearing surface has a very small gap from an end portion of said stationary projection, a cylindrical member is provided in a throughhole formed in said stationary projection and has therein an oiling passage passing through said small gap to come into contact with said spherical bearing surface, and said oiling passage of said cylindrical member is connected to said oiling passage formed in said spherical bearing surface.

4. A fluid machine according to claim 3, wherein a bearing is interposed between said stationary projection and said driven shaft, said high-pressure working gas containing lubricating oil is induced to said bearing through a passage extending in a radial direction of said cylindrical member.

* * * * *